US005847638A

United States Patent [19]

Sorenson

[11] Patent Number: 5,847,638

[45] Date of Patent: Dec. 8, 1998

[54] THERMAL CIRCUIT PROTECTOR AND SWITCH

[76] Inventor: Richard W. Sorenson, 6540 SE Harbor Cir., Stuart, Fla. 34996

[21] Appl. No.: 661,442

[22] Filed: Jun. 11, 1996

[51] Int. Cl.[6] ..... H01H 37/04; H01H 21/00

[52] U.S. Cl. ..... 337/380; 337/53; 337/59; 337/362; 200/553

[58] Field of Search ..... 337/51, 52, 53, 337/55, 59, 85, 102, 333, 362, 377, 380, 345; 200/553–557

[56] References Cited

U.S. PATENT DOCUMENTS 3,598,943 8/1971 Barrett ..... 200/553 X 5,498,846 3/1996 Chin ..... 200/557

5,541,568 7/1996 Jang ..... 337/68

*Primary Examiner*—Leo P. Picard

*Assistant Examiner*—Jayprakash N. Gandhi

*Attorney, Agent, or Firm*—McCormick, Paulding & Huber

[57] ABSTRACT

The circuit protector and switch has fixed and movable contacts. The movable contact is provided on the free end of a lever that is made in part from a bi-metallic element. Normally, this lever serves to open or close the contacts as a rocker is moved between "ON" and "OFF" positions. The rocker is biased toward its "OFF" position and has a fixed post that engages the contact lever at least in the "ON" position. The bi-metallic element changes shape to open the contacts in response to an overcurrent/overheat condition.

9 Claims, 5 Drawing Sheets

THERMAL CIRCUIT PROTECTOR AND SWITCH

BACKGROUND OF THE INVENTION

1. Field of the Invention

The present invention relates to thermal circuit protector devices which also function as "ON"/"OFF" switches, and deals more particularly with a simplified version for a thermal circuit protector/switch that provides an inexpensive substitute for more complex devices of this type.

2. Description of the Prior Art

Switches for use as either a thermal circuit protector or switch are known. For example, snap action bi-metallic elements have been provided for use in connection with thermal protectors of the type designed to provide a flag or insulative device between the contacts of the switch in response to an overload condition sensed by the bi-metallic element. See for example, U.S. Pat. Nos. 5,089,799 and 5,264,817 for examples of thermal protective switches of the type utilizing such a flag.

Other thermal protective devices that serve a switch function operate as a result of a push button action, and require that the push button be pulled back out in order to turn the device off. Butler, U.S. Pat. No. 3,311,725 illustrates a circuit breaker/switch of this general type.

Still other thermostatic switches have a snap action disc that can be reset by a push button (See U.S. Pat. Nos. 4,791,397 and 4,628,295 for examples of such a device).

Although, much more complicated, and therefor expensive to manufacture, thermal circuit breakers are known also (See U.S. Pat. Nos. 4,931,762; 4,937,548 and 4,258,349).

The general purpose of the present invention is to provide a thermal switch/breaker that does not require a flag, and which can be operated as, and give the appearance of being, a conventional rocker switch, and wherein the device is also capable of "trip free" operation so that even if held in the "ON" position, will not result in sustained closing of the contacts.

SUMMARY OF THE INVENTION

In accordance with the present invention, an upwardly open hollow housing is provided with a bottom wall and defines a top opening for pivotably receiving a rocker/actuator. The actuator includes a depending post which need not be provided with a spring loaded plunger as is the case with a conventional rocker switch. Rather, the lower end of the post projects inside the housing for directly engaging a movable contact lever.

The movable contact lever has a free end which is provided with a movable switch contact, and the contact lever is biased toward a position such that the movable contact is normally spaced from a fixed contact. The actuator post end portion acts on this movable contact lever to hold it in engagement with the fixed contact in the "ON" position. The movable contact lever is defined at least in part by a bi-metallic element which exhibits a thermally responsive change in shape or curvature such that the movable contact moves away from the fixed contact in response to a predetermined temperature rise of the bi-metallic element.

Biasing means in the form of a compression spring may be provided between the underside of the rocker and the movably mounted end portion of the contact lever in order to assure that the rocker is urged towards its "OFF" position especially when the contacts are opened as a result of an over temperature condition, so as to provide a "trip free" operation, and to assume upward movement of the movable contact to open the contacts in the "OFF" position.

In the preferred embodiment, the movable contact lever is pivotably mounted on the upper end of one of two fixed terminals in the switch housing bottom wall. The other fixed terminal is provided with the fixed contact on its upper end inside the switch housing.

The movable contact lever also has a medial portion between its movable or pivotable end portion, and its free end portion, for engagement with the lower end of the actuator post. This medial portion defines an abutment for engagement with the end of the actuator post to provide a stable switch "ON" position at least in the absence of a thermal over heat condition of the bi-metallic element. The medial portion may also define the juncture between the bi-metallic element and the remainder of the movable contact lever which is fabricated from a conventional conductive metal material.

In one alternative design, the movable contact lever engages a stop when sensing an overheat condition to positively disengage the abutment in its medial portion from the actuator post and provide positive actuator movement to "OFF".

In another alternative design, a resistive element is provided adjacent to or as part of the bi-metallic element for generating additional heat in an over current condition to assure positive operation of the bi-metallic element and positive opening of the contacts.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings, and wherein.

DETAILED DESCRIPTION OF ONE PREFERRED EMBODIMENT

(FIGS. 1–4)

Figure 1:
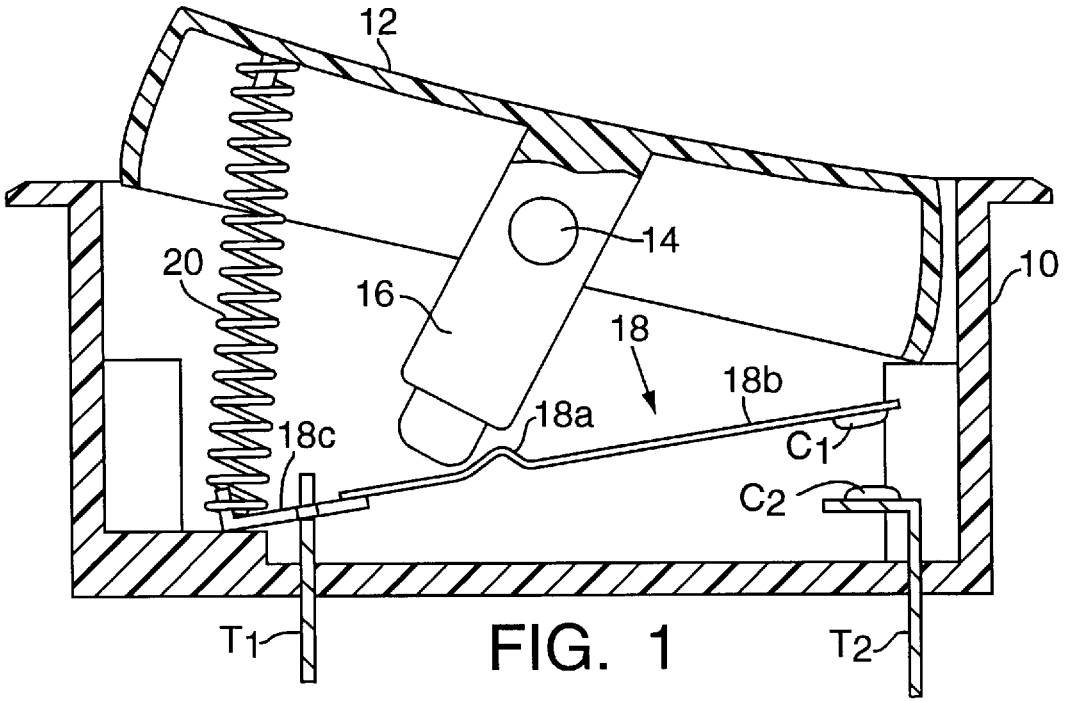
FIG. 1 shows in vertical section, a thermal circuit protector and switch, the rocker/actuator being in the "OFF" position, as is the movable contact lever.
Figure 2:
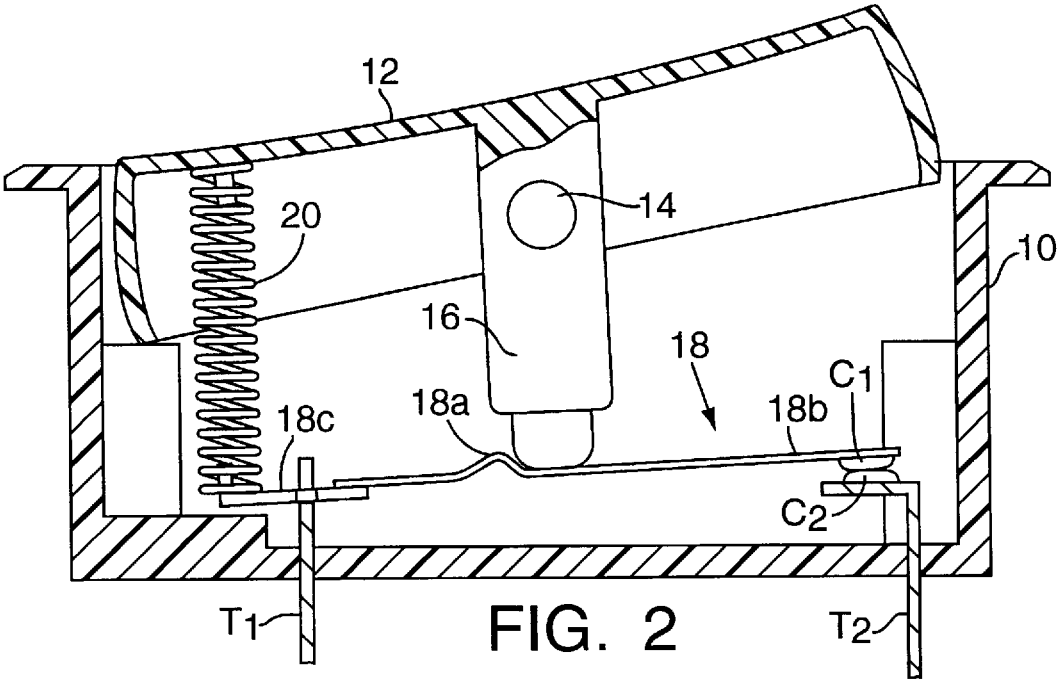
FIG. 2 is a vertical section similar to FIG. 1, but illustrating the rocker/actuator and movable contact lever in their "ON" positions.

Referring now to the drawings in greater detail, FIG. 1 shows a housing 10 of the type having a generally rectangular upwardly open cavity containing the moving parts of the switch. A pivotally mounted rocker/actuator 12 is provided with laterally extending axle defining projections on either side as indicated generally at 14, which projections are received in openings provided for this purpose in the housing side walls to permit movement of the rocker/actuator from its "OFF" position shown in FIG. 1 to its "ON" position as illustrated in FIG. 2.

The actuator 12 includes a depending post 16 which is preferably formed integrally with the rocker/actuator, and is therefore unlike a conventional post in a conventional rocker switch actuator where the lower end of the post comprises a spring loaded plunger. The lower end of the post 16 is adapted to engage a movable contact lever 18 so as to urge the contact lever from the "OFF" position shown for it in FIG. 1 to the "ON" position of FIG. 2 as a result of movement of the acuator as described.

The free end portion 18*b* of the contact lever 18 includes a first contact $C_1$ that is adapted to engage a fixed contact $C_2$ provided for this purpose on the terminal $T_2$ that is mounted in the bottom wall of the housing for this purpose.

The movable contact lever 18 has one end portion that is pivotable to allow movement of the free end portion. As shown, the one end portion, indicated generally at 18*c* in FIGS. 1 and 2, is pivoted on a fixed terminal $T_1$. This pivoted end portion 18*c* is fabricated from a conductive material. The pivoted end portion 18*c* of the contact lever 18 further includes an upstanding tang that receives one end of a coiled compression spring 20. The other end of spring 20 engages the underside of the rocker 12 such that the lever 18 is continually biased towards the "OFF" condition of FIG. 1, and so that the rocker 12 is also biased towards its "OFF" condition as suggested in FIG. 1.

The switch housing 10, and more particularly the bottom wall thereof, includes the two terminals $T_1$ and $T_2$. The terminal $T_1$ serves as a support for the pivoted end portion of the contact lever 18 whereas the second terminal $T_2$ supports the fixed contact $C_2$ for cooperation with the movable contact $C_1$ that is provided at the free end portion of the contact lever 18 for this purpose. As shown in FIG. 2, an abutment or raised rib portion 18*a* is provided at a medial portion of the contact lever 18 for engagement with the end portion of the post 16 to define a positive "ON" position for the switch, and to counteract the biasing force exerted by the spring 20. As so constructed and arranged, the above-described switch is adapted to serve as a conventional rocker switch.

In accordance with the present invention, the movable contact lever 18 may comprise a single one piece element, but in the preferred embodiment, and as shown in FIGS. 1–4 actually comprises two components or elements. The free end portion 18*b* of the lever 18 includes a bi-metallic portion that is joined at one end to the pivoted portion 18*c* of the lever 18. The pivoted end portion 18*c* of the contact lever 18 is thus of one material and the free end portion of 18*b* of another material. The fact that the contact lever 18 is fabricated from two separate components does not detract from the fact that the switch operates as a conventional rocker switch as described above with reference to FIGS. 1 and 2.

Figure 3:
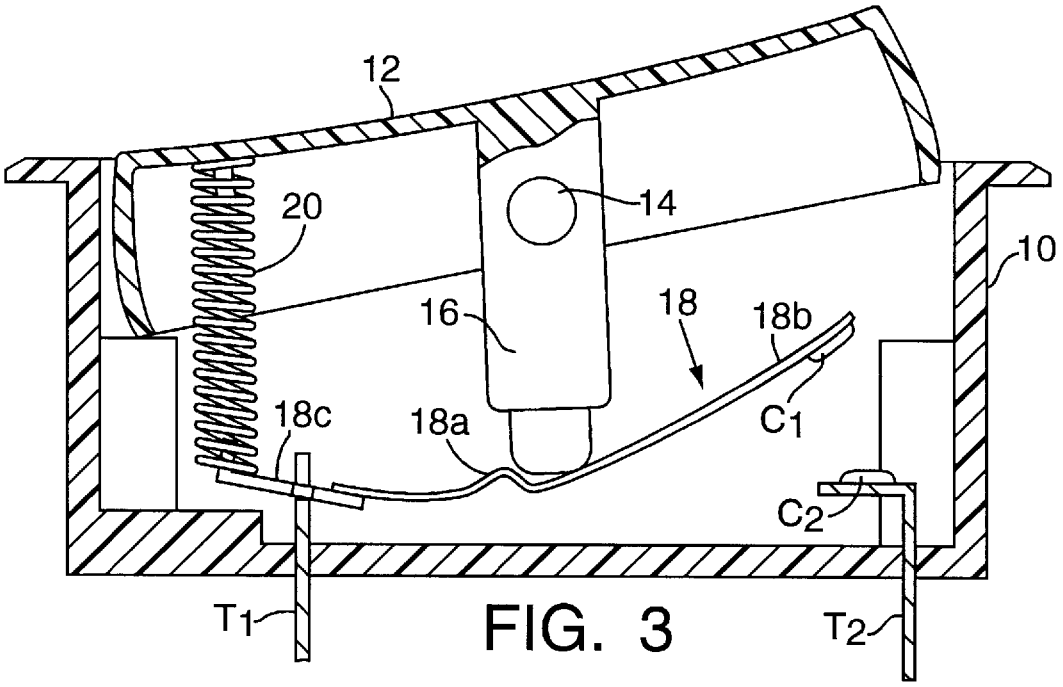
FIG. 3 is a view similar to FIG. 2, but illustrating the movable contact lever in a deformed condition such as would occur during an over current condition, if the rocker/actuator were held in the "ON" position.
Figure 4:
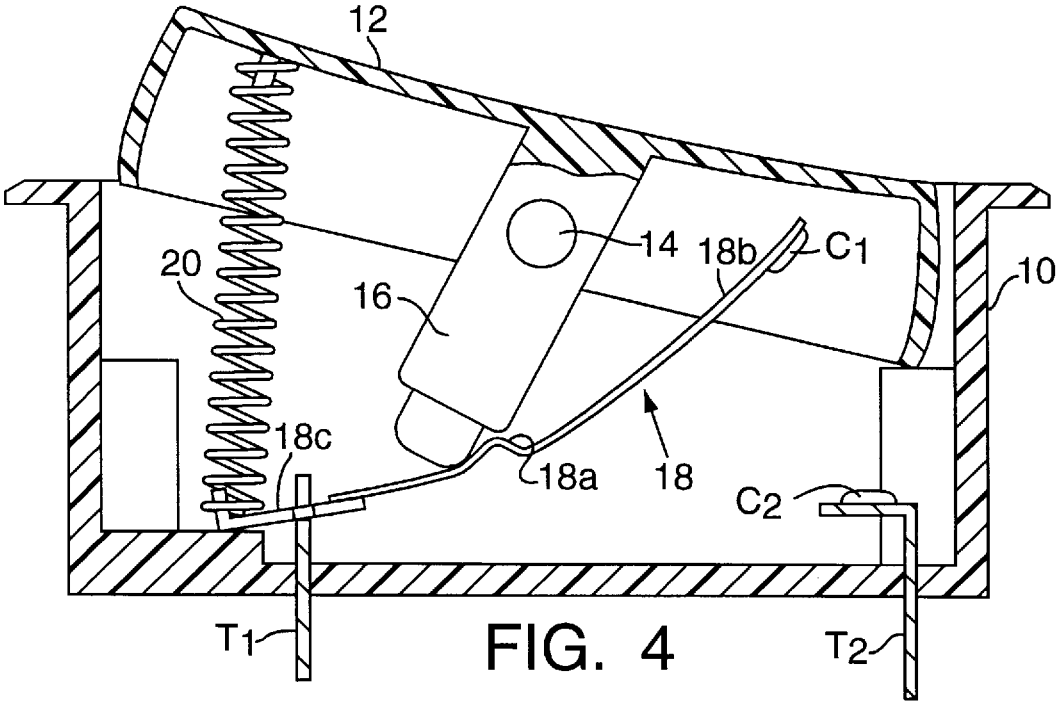
FIG. 4 is a view similar to FIGS. 1, 2 and 3, but illustrating the movable contact lever still in a deformed condition per FIG. 3 and the rocker/actuator in its normal "OFF" position.

Turning now to a more detailed description of FIGS. 3 and 4, it is an important feature of the present invention that the bi-metallic component or element of the lever 18 is adapted to assume a curved condition in response to a predetermined temperature rise, all as known from the technology associated with such bi-metallic elements generally. In response to an over current condition as suggested in FIG. 4, the heating effect of such an over current condition causes the bi-metallic component of the lever 18 to assume the curved configuration quite different from the generally flat configuration of the movable contact lever 18 as illustrated in FIG. 1. FIG. 3 shows the same overheated condition for the contact lever 18 as shown in FIG. 4. More particularly, with the rocker 12 held in its "ON" position, the contacts $C_1$ and $C_2$ nevertheless are still able to open as the contacts cycle from open to closed during an overload condition.

FIG. 4 illustrates that the biasing force from the spring 20 acts on both the rocker and the bi-metal contact lever to assure that the movable contact remains open even when the rocker is released, allowing the bi-metal to cool down and assume its normal configuration once again. In the event that the rocker is held in its "ON" position against these spring forces. Once the bi-metallic element has cooled down, the contacts can then reclose, but if the over current condition persists, the contacts will again reopen. FIG. 3 represents an unstable configuration for the switch components to illustrate the "trip free" function for the thermal protector and switch of the present invention.

The post 16 may be integrally formed with the rocker 12 as mentioned previously. However, the bi-metallic element is intended to be heated as a result of an over current condition, and therefore, the lower end of the post may be fabricated from a material able to withstand the actual temperatures achieved in the bi-metallic elements.

DETAILED DESCRIPTION OF SECOND PREFERRED EMBODIMENT (FIGS. 5–8)

Referring now to FIGS. 5–8 in greater detail, a version of a thermal circuit protector/switch of the present invention is substantial similar to that depicted in the embodiment of FIGS. 1–4 and more particularly includes the same housing 10 for containing the movable parts of the device. A movable mounted rocker/actuator 12 is provided with laterally extending axial defining projections on either side as indicated generally at 14, which projections are received in openings provided for this purpose in the housing sidewalls to thereby permit pivotal movement of the rocker/actuator from its "OFF" position shown in FIG. 5 to the "ON" position illustrated in FIG. 6.

Figure 5:
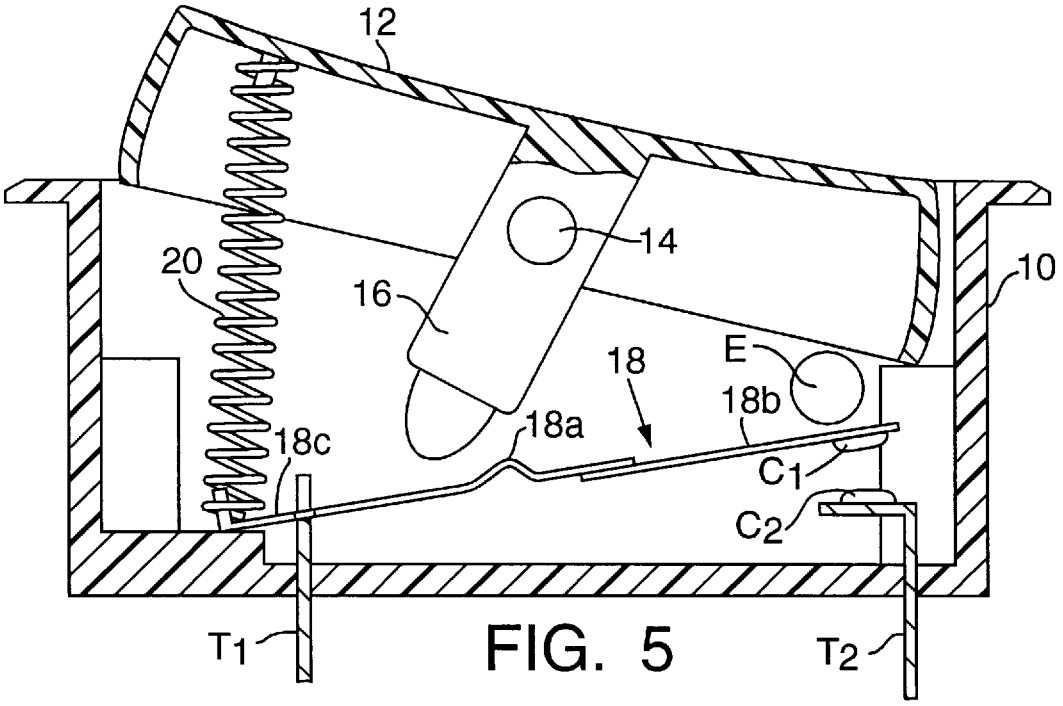
FIG. 5 shows in vertical section an alternative embodiment of a thermal circuit protector and switch, the rocker/actuator being in the "OFF" position, as is the movable contact lever.
Figure 6:
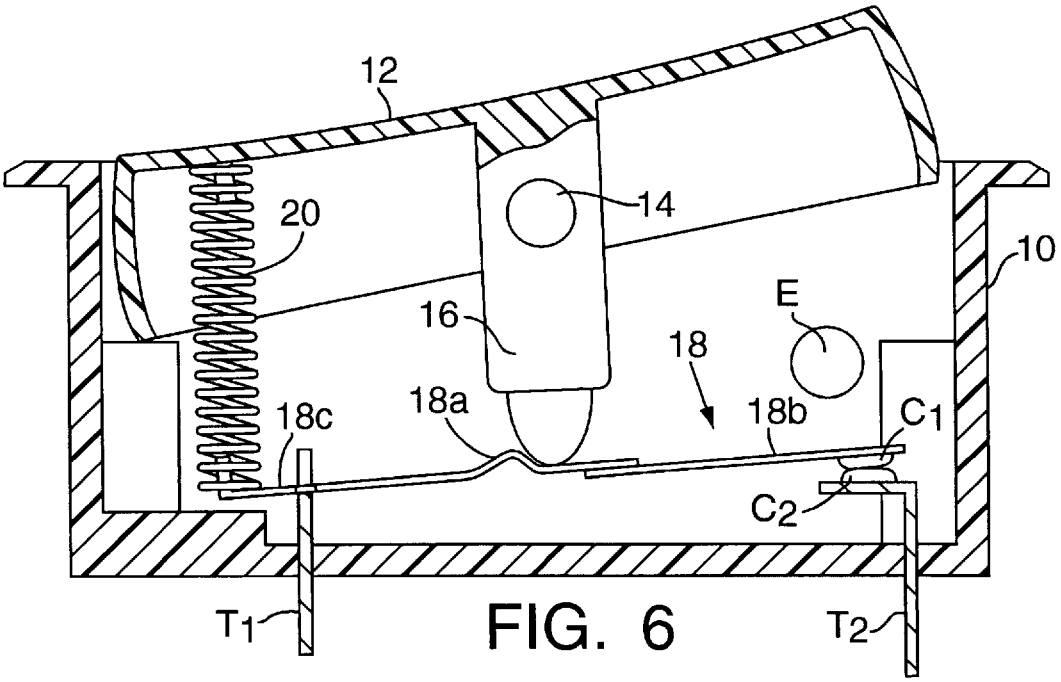
FIG. 6 is a vertical section similar to FIG. 5 but illustrating the rocker/actuator movable contact lever in their "ON" positions.

The actuator of FIGS. 5–8 like that described previously with reference to FIGS. 1–4 includes a depending post 16 which may be formed integrally with the rocker/actuator and is, therefore, unlike a conventional post of a conventional rocker switch, where the lower end of the post comprises a spring loaded plunger. In fact, the embodiment of FIGS. 5–8 shows that the lower end of the post need not continually engage the movable contact lever except when utilized to move the movable contact lever to its "ON" position as shown in FIG. 6. In the "OFF" position of FIG. 5, the lower end of the post in the rocker/actuator of FIG. 5 is moved out of contact with the movable contact lever and the force of biasing spring 20 is relied upon to urge the movable contact lever 18 and hence, separate the fixed and movable contacts $C_2$ and $C_1$ respectively, and define the "OFF" position for the device. A fixed stop E may be molded into the switch housing for limiting such movement of the movable contact lever 18 as shown in FIG. 5.

As in the previously described embodiment, the movable contact lever 18 supports a first contact $C_1$ that is adapted to engage a fixed contact $C_2$ provided for this purpose on the terminal $T_2$ which is mounted on the bottom wall of the housing for this purpose.

The movable contact lever 18 is pivotably provided atop the fixed terminal $T_1$, and the free end portion 18*b* supporting the movable contacts $C_1$. The pivoted end portion 18*c* of the movable contact lever is preferably fabricated from a conductive material such as copper, and may be silver plated in part to better conduct electricity between it and the upper end of the fixed terminal $T_1$. The pivoted end portion of the movable contact lever 18 further includes an upstanding tang that receives one end of a coil compression spring 20. The other end of the spring 20 engages the underside of the rocker 12 such that the movable contact lever 18 is continually biased towards its "OFF" condition as depicted in FIG. 5.

As mentioned, the switch housing has fixed terminals $T_1$ an $T_2$ supported in its bottom wall as was true of the embodiment described with reference to FIGS. 1–4. The movable contact lever 18 is provided with a raised rib portion 18*a* that is defined in the above-mentioned conductive copper portion of the movable contact lever rather than on the bi-metallic portion thereof as disclosed in the embodiment of FIGS. 1–4. This configuration avoids the necessity for defining the abutment at the medial portion of the movable contact lever 18 in the bi-metallic material itself. However, the purpose of this abutment 18*a* is substantially the same as that described above with reference to FIGS. 1–4 in that a positive stable condition is provided for the on condition as depicted in FIG. 6. The biasing force of the spring 20 is effectively overcome by the interaction between the lower end of the post 16 and the abutment 18*a* on the movable contact lever 18. Turning now to a more detailed description of FIGS. 7 and 8, it is an important feature of this embodiment as well as that of FIGS. 1–4 that the bi-metalllic component or element of the lever 18 is adapted to assume a curved condition in response to a predetermined temperature rise all as known from the technology associated with such bi-metallic elements generally. In response to an overcurrent condition as suggested in FIG. 8, the heating effect of such an overcurrent condition causes the bi-metallic component of the lever 18 to assume the curved configuration shown, which configuration is quite different from the generally flat configuration of the movable contact 18 as illustrated in FIG. 5 for example. More particularly, with the rocker 12 held in an "ON" position as suggested generally by the force F exerted on the rocker of FIG. 7, the contacts $C_1$ and $C_2$ are nevertheless able to cycle from open to closed during an overload condition.

Figure 8:
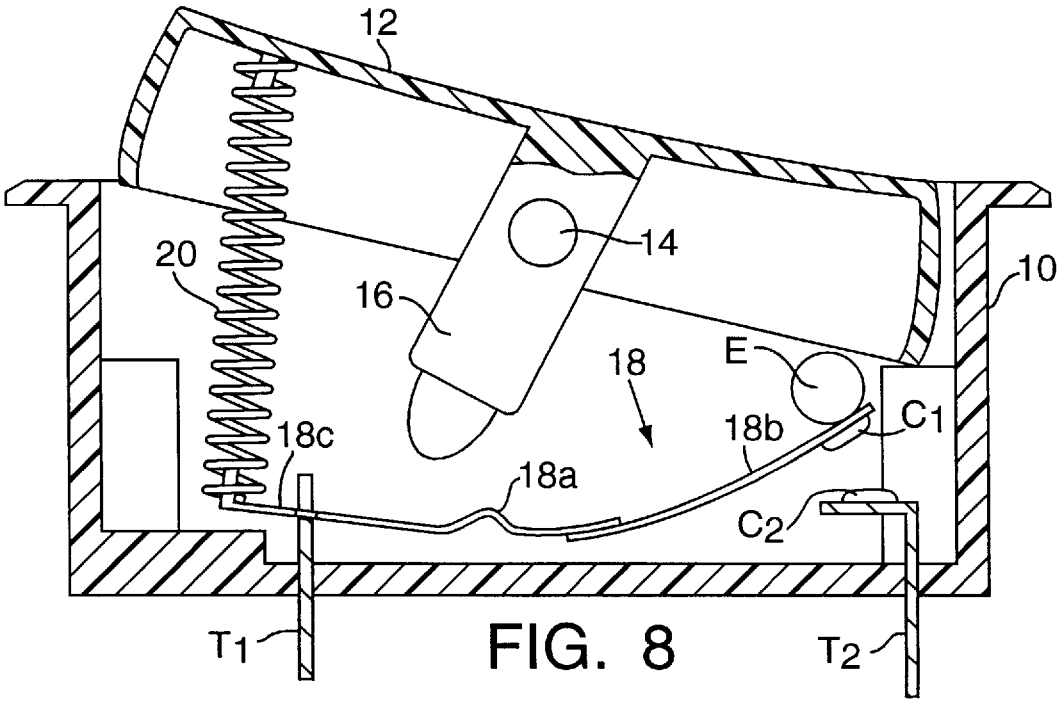
FIG. 8 is a view similar to FIGS. 4, 5, and 6 but illustrating the movable contact lever still in its deformed condition as shown in FIG. 6, and with the rocker/actuator in its normal "OFF" position.

FIG. 8 illustrates that the biasing force from the spring 20 acts on both the rocker and the bi-metal contact lever 18 to assure that the movable contact $C_1$ remains open even when the rocker is released, allowing the bi-metal to cool down, and assume its normal configuration once again.

Figure 7:
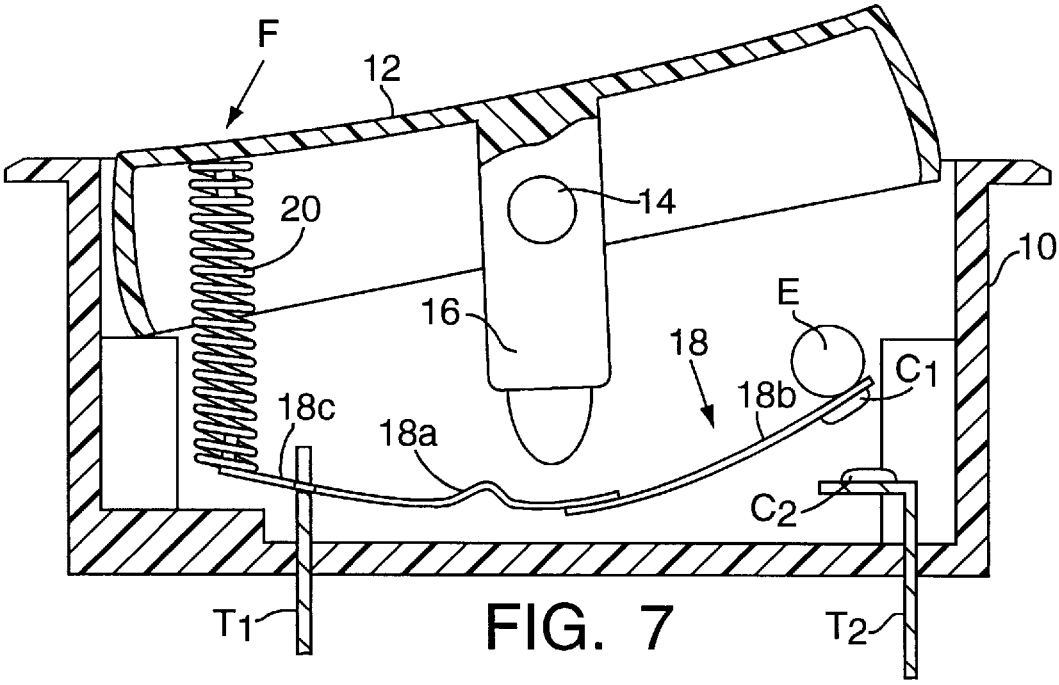
FIG. 7 is a view similar to FIG. 6, but illustrating the movable contact lever in a deformed condition, such as would occur during an overcurrent condition if the rocker/actuator were held in the "ON" position.

In the event that the rocker is held in its "ON" position against such spring force as suggested in FIG. 7, the bi-metallic element will cycle between its normal cool down condition and its heated condition to cycle the movable contact $C_1$ open and then to reclose again as long as the rocker is so held and the overcurrent condition persists. FIG. 7 illustrates an unstable configuration for the thermal circuit protector/switch components and illustrates the "trip free" function served by this embodiment of the present invention.

The fixed stop E which is provided in the housing 10 to act on the movable contact lever free end portion also serves to disengage the rocker/actuator post 16 and thereby allow the rocker/actuator to readily turn to its "OFF" position as illustrated in FIG. 8. Other than serving to restrict such movement of the bi-metallic movable contact lever and aiding in the disengagement of that lever from the post, the operation of the thermal circuit protector switch of FIGS. 5–8 is similar to that previously described with reference to FIGS. 1–4.

DETAILED DESCRIPTION OF FIG. 9

Figure 9:
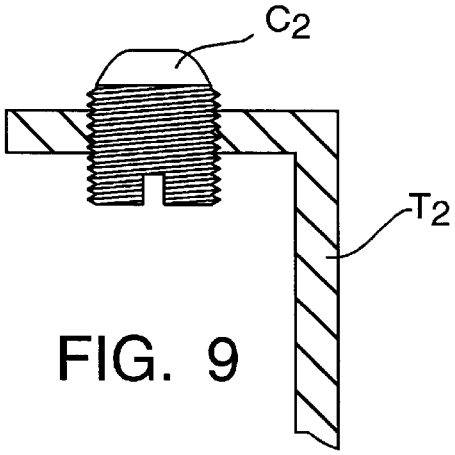
FIG. 9 shows an alternative construction for a fixed contact suitable for use in either of the embodiments depicted in FIGS. 1–4 or FIGS. 5–8.

FIG. 9 illustrates an alternative configuration for the fixed terminal $T_2$ in the bottom wall of the housing 10 in the device of either FIGS. 1–4 or that of FIGS. 5–8. More particularly, the fixed contact $C_2$ in the terminal of $T_2$ of FIG. 9 is provided adjustably on that fixed terminal $T_2$ in order to provide adjustable means for altering both the contact pressure provided between the contacts $C_1$ and $C_2$, and the degree of deformation of the bi-metallic contact lever in its normal temperature range, and in the "ON" position. This feature enables adjustments and calibration of the trip point or thermal temperature (electrical resistive heating effect) necessary to achieve the desired deformation of the bi-metal to achieve an open contact condition.

DETAILED DESCRIPTION OF FIG. 10

Figure 10:
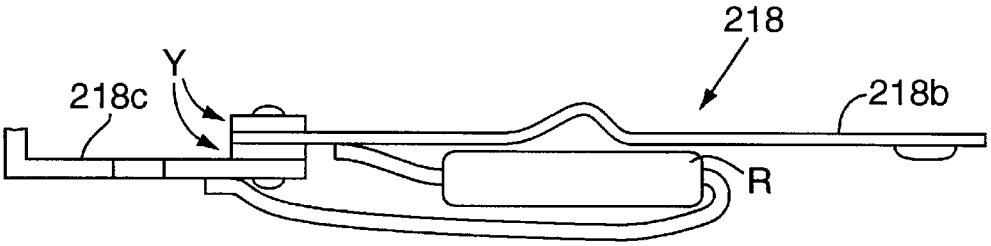
FIG. 10 is a view illustrating a movable contact lever of alternative construction suitable for use in the embodiments of FIGS. 1–4 or that of FIGS. 5–8.

FIG. 10 shows an alternative configuration for the movable contact lever 218. The pivoted end portion A of the lever 218 is joined to the bi-metallic portion 218*b* with an insulation Y,Y provided between them. A conductive electrical path around this insulated joint is provided through a resistor indicated generally at R. The resistor R is so located relative to the bi-metallic 218*b* that heat is assured in this bi-metallic material as a result of an overcurrent. Thus, a resistor R provides a more positive response from the bi-metallic element to assure that it reaches the necessary curved configuration in order to establish a positive opening of the contacts $C_1$ and $C_2$. Such a movable contact lever as that depicted in FIG. 10 can be adapted for use in both the version of FIGS. 1–4 and the version of FIGS. 5–8.

DETAILED DESCRIPTION OF FIG. 11

Figure 11:
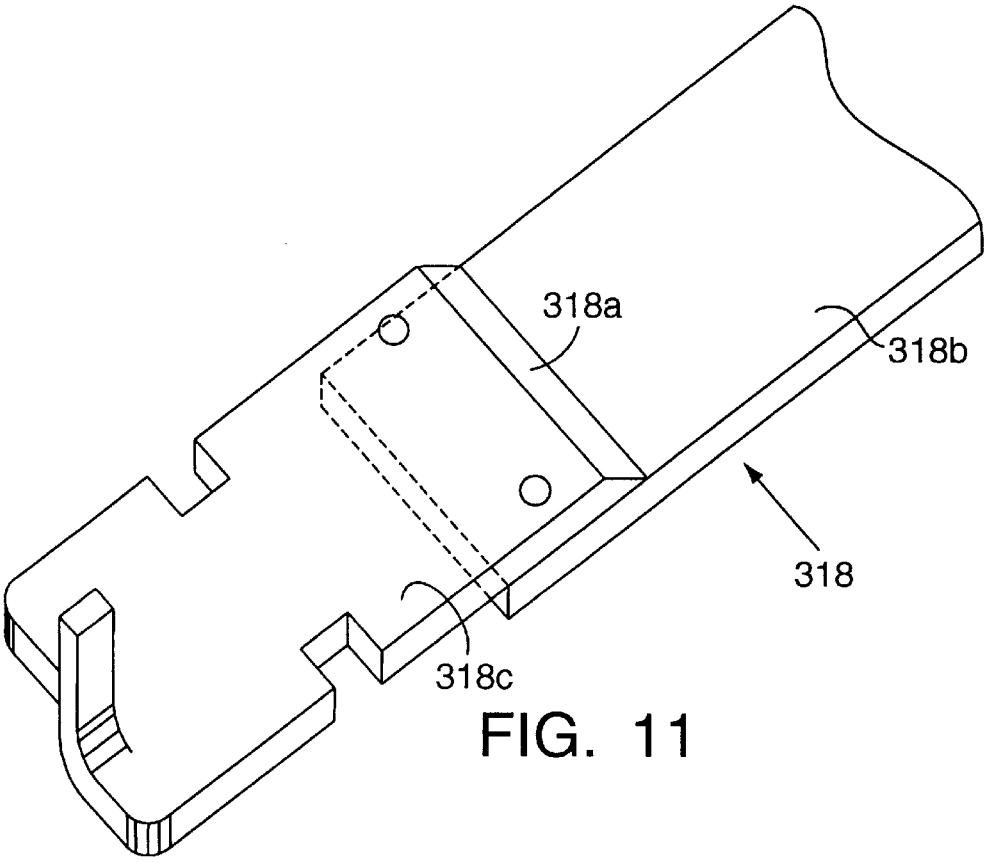
FIG. 11 is a perspective view of a movable contact lever of still another alternative construction, only a portion of the lever being illustrated, and illustrating a medial portion of the lever defined by the joint provided between the bi-metallic portion thereof and the conductive pivoted movable end portion thereof.

FIG. 11 shows still another version for the movable contact lever 318 adapted for use in the embodiments either of FIGS. 1–4 or FIGS. 5–8. In FIG. 11, the movable contact lever 318 has a bi-metallic component 318*b* which is connected to the underside of the pivoted end portion 318*c*, of the contact lever 318. The lap joint is defined at this juncture and serves to also define the lip or abutment 318*a* which continuously or selectively engages the lower end of the post 16 in both the device of FIGS. 1–4 or the device depicted in FIGS. 5–8.

I claim:

1. A thermal circuit protector and switch comprising:

a hollow housing having a bottom wall and defining a top opening, fixed and movable switch contacts normally spaced from one another inside said hollow housing, first and second switch terminals projecting from said housing and electrically connected to said fixed and movable switch contacts respectfully, an actuator movably mounted in said housing, and having a portion accessible through said top opening for movement of said actuator manually between "ON" and "OFF" positions, said actuator including a depending post fixed to said actuator whereby said post has an end portion movable between "ON" and "OFF" positions as said actuator is so moved, a movable contact lever connected to said first terminal and having a free end portion supporting said movable switch contact, said movable contact lever being biased toward and "OFF" position, wherein said movable contact is spaced from said fixed contact, said post end portion acting on said movable contact lever to hold said movable contact in engagement with said fixed contact in said "ON" position of said post and actuator, and said movable contact lever defined at least in part by a bi-metallic element that changes its shape or curvature in response to an increase in temperature such that the movable contact moves away from the fixed contact in response to a predetermined temperature rise of said bi-metallic element.

2. The thermal protector and switch of claim 1, wherein said actuator can be moved manually to its "ON" position thereby moving said post towards its "ON" position, while said free end portion of said movable contact lever remains spaced from said fixed contact as a result of said bi-metallic element thermally responding to a temperature rise to assume such change in curvature to provide a "trip free" condition for said circuit protector and switch.

3. The thermal protector and switch of claim 2 wherein said movable contact lever further includes a pivoted end portion opposite said free end portion and a medial portion between said pivoted and free end portions, said post end portion being in continuous slidable engagement with said medial portion as said actuator is so moved between "ON" and "OFF" positions.

4. The thermal protector and switch of claim 2, wherein said movable contact lever is not engaged by said post and portion in said "ON" position thereof, and is not engaged by said post end portion during an overcurrent condition, and a stop provided in said housing for engaging said free end portion of movable contact lever and thereby prevent engagement between it and said post end portion as aforesaid.

5. The thermal protector and switch of claim 3 or 4 wherein said medial portion of said movable contact lever defines an abutment that is engaged by said post end portion to normally hold said free end portion of said movable contact lever in a position to cause engagement between said fixed contact and said movable contact, and thereby define a switch "ON" condition.

6. The thermal protector and switch of claim 3 or 4, wherein said pivoted end portion of said movable contact lever is defined by a metallic conductive element that is joined to said bi-metallic thermally responsive element.

7. The thermal protector and switch of claim 3 or 4 further characterized by biasing means to urge said actuator toward its "OFF" position, and said biasing means also acting on said movable contact lever to urge said lever toward its "OFF" position.

8. The thermal protector and switch of claim 3 or 4, wherein said pivoted and free end portions of said movable contact lever are secured to one another, and wherein an electrical resistor is provided between said pivoted and said free end portions, said resistor being in a position to generate heat for improving the thermal responsiveness of bi-metallic element to an over current condition in said movable contact lever.

9. The thermal protector and switch of claim 3 or 4, wherein said fixed contact is adjustably mounted in said housing for limited movement toward and away from said bottom wall.

* * * * *